United States Patent [19]

Kawakami et al.

[11] 4,256,198

[45] Mar. 17, 1981

[54] ACOUSTIC APPARATUS

[75] Inventors: Yasushi Kawakami; Hiroshi Iwasaki, both of Tokyo, Japan

[73] Assignee: Nissan Motor Company, Limited, Yokohama, Japan

[21] Appl. No.: 927,687

[22] Filed: Jul. 25, 1978

[30] Foreign Application Priority Data

Aug. 6, 1977 [JP] Japan ..... 52/105280[U]

[51] Int. Cl.[3] ..... H04R 7/00

[52] U.S. Cl. ..... 181/141; 521/83; 521/101; 521/151; 521/174; 181/166; 181/171; 181/199; 181/DIG. 1

[58] Field of Search ..... 181/171, 157, 166, 148, 181/199, 141, 151, DIG. 1, 146, 294; 179/180, 1 E, 146 E; 521/83, 101, 151, 174

[56] References Cited

U.S. PATENT DOCUMENTS

| | | | |
|---|---|---|---|
| 2,970,060 | 4/1961 | Roberts | 181/151 |
| 3,384,719 | 5/1968 | Lanzara | 181/DIG. 1 |
| 3,385,393 | 5/1968 | Gold | 181/141 |
| 3,478,840 | 11/1969 | Victoreen | 181/166 |
| 3,549,829 | 12/1970 | Heidrich | 181/166 |
| 3,720,285 | 3/1973 | Russell et al. | 181/DIG. 1 |
| 3,987,245 | 10/1976 | Fasen et al. | 179/180 |
| 3,993,345 | 11/1976 | Croup | 181/199 |
| 4,127,751 | 11/1978 | Kinoshita | 181/151 |
| 4,136,755 | 1/1979 | Goes | 181/151 |

FOREIGN PATENT DOCUMENTS

| | | | |
|---|---|---|---|
| 1367937 | 6/1964 | France | 181/DIG. 1 |

*Primary Examiner*—L. T. Hix
*Assistant Examiner*—Benjamin R. Fuller

[57] ABSTRACT

A loudspeaker having a framework with a plurality of openings therein is fitted with an elastic body of a bitumen-containing urethane foam over the rearside of the framework to absorb the acoustic energy transmitted rearwardly from the speaker.

6 Claims, 6 Drawing Figures

ACOUSTIC APPARATUS

BACKGROUND OF THE INVENTION

The present invention relates to loudspeakers in general, and more particularly to an acoustic apparatus including a loudspeaker fitted with an acoustic absorber on the rear side for absorption of unwanted rearward acoustic energy which might create undesirable resonant peaks in the rear low frequency end of the audible frequency spectrum.

The conventional method of absorbing acoustic energy emanating rearwardly from a loudspeaker involves the use of a thick layer of absorbent material such as glass wool or cotton, or a multiple layers of such material as felt. However, the prior art absorbent material has not sufficient degree of acoustic absorption capability, particularly for the energy in the lower frequency end of the audible frequency spectrum so that a large amount of such absorbent material was needed, and in order to obtain a flat frequency response characteristic an enclosure is required which is fitted inside with a layer of such absorbent material. However, the use of the enclosure still presents a problem in that since the absorbent layer is located afar from the point of acoustic energy generation, it is difficult to completely absorb the energy which reflects back and forth within the enclosure and to prevent the framework of the speaker unit from being vibrated. Furthermore, the conventional absorbent materials lack elasticity and viscosity so that they cannot be easily secured in position to the rearside of the loudspeaker.

In automotive applications, it is desirable to directly mount the speaker on a parcel shelf of the vehicle which serves as a baffle plate to utilize the rear compartment of the vehicle as an enclosure. However, for acoustic absorption purposes, the inside walls of the rear compartment would have to be fitted with a layer of an acoustic absorber, which would increase the labor and material costs.

SUMMARY OF THE INVENTION

A primary object of the present invention is to absorb acoustic energy emanated rearwardly from a loudspeaker by mounting a layer of an acoustic absorber having a high absorption characteristic in the lower frequency end of the audible frequency spectrum directly on the rearside of the speaker.

Another object is to provide an elastic bitumen-containing urethane foam which is formed into a shape easily secured to the rear of a loudspeaker.

A further object of the invention is to provide an acoustic apparatus which is particularly suitable for automotive applications in terms of labor and material costs.

The acoustic absorber employed in the present invention is a bitumen-containing urethane foam which is prepared by mixing in the liquid phase a hydrocarbon-containing bitumen composition, synthetic resinous compositions and a foaming agent, and allowing the mixture to foam within a mould which is so shaped that the bitumen-containing urethane foam is easily adapted to the rear of the loudspeaker. The foam is cured by heating at an elevated temperature. Since the foam is elastic, it can be easily secured to the rear of the loudspeaker by squeezing the former to the latter's framework.

BRIEF DESCRIPTION OF THE DRAWINGS

The invention will be further described with reference to the accompanying drawings, in which.

DETAILED DESCRIPTION

Figure 1:
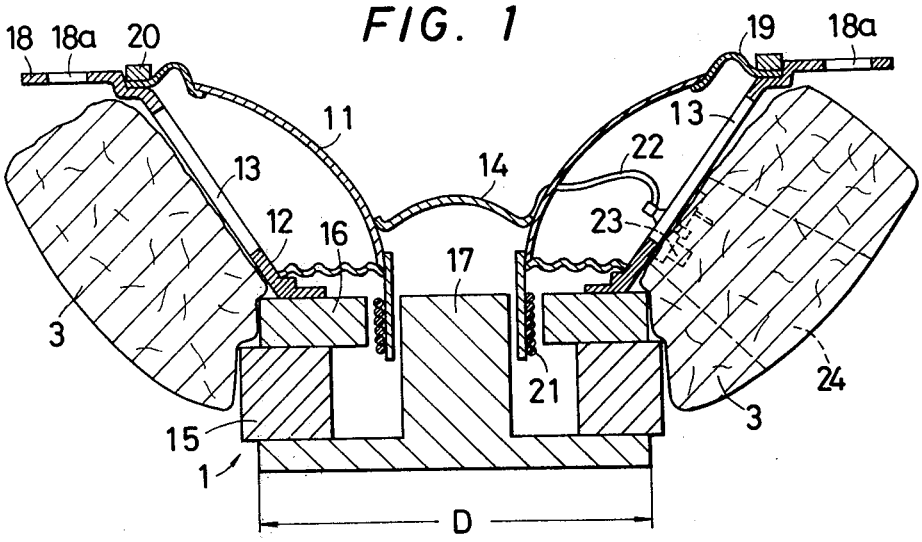
FIG. 1 is a cross-sectional view of acoustic apparatus of the invention.

The loudspeaker unit of the present invention depicted in FIG. 1 comprises a conventional loudspeaker 1 having a cone-shaped diaphragm 11 with a center cap 14 secured to a voice coil 21, the voice coil being disposed within a cylindrical air gap formed by an annular pole piece 16 mounted on a ring-shaped permanent magnet 15, and a center pole piece 17 which extends into the voice coil 21, all of which constitute a driving unit of the speaker 1. The conical diaphragm 11 is resiliently secured at its periphery by means of a curved edge member 19 to the outer edge of a conical framework 12 having a plurality of openings 13 which permit the sound waves generated by the diaphragm to escape therethrough to the rearward space to prevent objectionable interaction with the frontal sound waves. The pole piece 16 also serves as a base on which the framework 12 is mounted. The outer periphery of the conical framework 12 is bent horizontally to form a stepped flange 18 formed with a plurality of fixing holes 18*a*. An annular gasket 20 is secured to the edge member 19 of the diaphragm to provide a resilient contact with a baffle plate (not shown) to which the flange 18 of the framework is attached by means of screws extending through the holes 18*a*. A pair of conductors 22 is shown connected from a terminal 23 on the framework to the voice coil 21.

According to the present invention, an acoustic absorber 3 is secured to the outer conical surface of the speaker framework 12 in face-to-face relation to absorb the acoustic energy emanated rearward from the diaphragm 11. The absorber 3 is formed with an opening 24 which, when the absorber is fitted in position, permits an electrical connection to be made from the terminal 23 to an external circuit which energizes the speaker.

Figure 2:
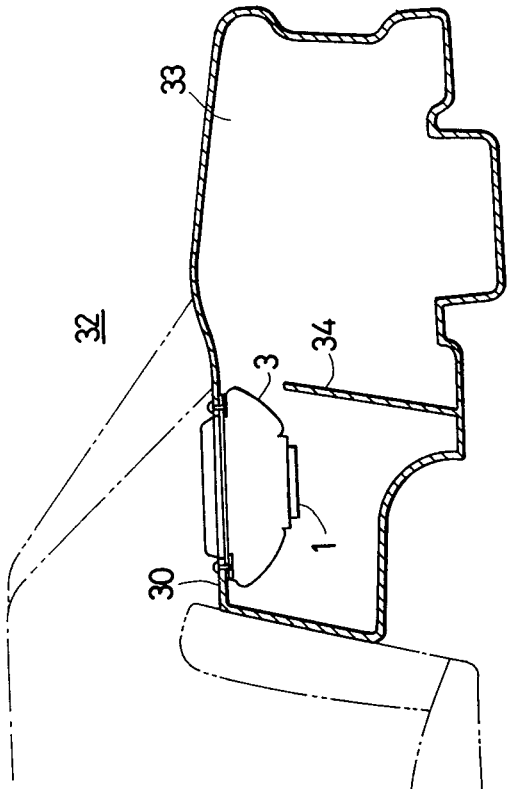
FIG. 2 is a cross-sectional view of a rear compartment of an automotive vehicle showing the apparatus of the invention mounted on a parcel shelf of the passenger compartment.

The acoustic absorber 3 is so provided that it entirely covers the rearward surface of the framework 12, and preferably covers entirely the driving unit of the loudspeaker 1. Because of the proximity to the diaphragm 11, the acoustic absorber 3 offers an acoustic resistance of a substantial magnitude to the rearwardly emanating sound waves so that the latter is attenuated to such a low energy level that it no longer interacts with the frontal sound waves if the rearward space of the speaker 1 is separated from the frontal space by means of a suitable baffle plate such as provided by a parcel shelf 30 of an automobile 32 illustrated in FIG. 2 so that its rearward sound waves emanate into a trunk room 33 which is separated from the immediate area of the speaker 1 by a vertical wall 34.

In a practical embodiment, the acoustic absorber comprises a bitumen-containing urethane foam. As disclosed in Japanese Patent Application (Tokkyo Kokai Koho) No. Sho 42-151395, which was laid open to public inspection on Dec. 15, 1977, the bitumen-containing urethane foam comprises:

(a) 100 parts in weight of a polyol of the polydiene group;
(b) 50 to 500 parts in weight of a bituminous compound which is substantially comprised by hydrocarbon having a melting point of 150° C. or less and a boiling point of 200° C. under the normal atmospheric pressure;
(c) a foaming agent;
(d) an additive agent; and
(e) a polyisocyanate, the weight of its isocyanate base is in a range between 0.8 and 1.25 in relation to the polyol composition and other active hydrogen molecules.

Figure 3A:
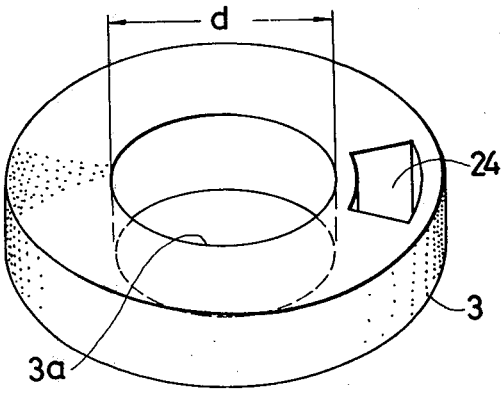
FIG. 3A is a perspective view of the acoustic absorber of FIG. 1.
Figure 3B:
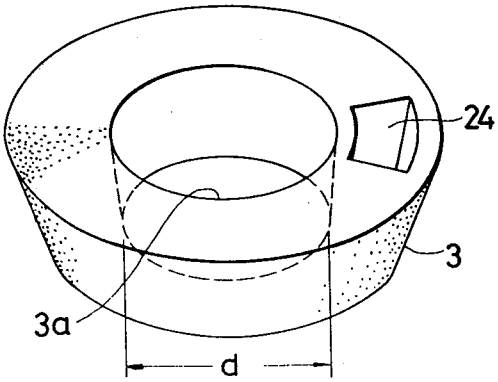
FIG. 3B is a perspective view of a modified form of the absorber.

The aforesaid compositions are mixed in liquid phase and allowed to foam within a mould so as to form an absorber as shown in FIG. 3A or 3B such that it has an air transmissivity of approximately 25 cc/cm$^3$/sec. This air transmissivity is obtained by suitably selecting the foaming agents such as silicon surfactant, a catalyst of the tin group and an amine catalyst and selecting the proportions of the constituent compositions. Precise control of the air transmissivity is carried out by perforating the foamed material within a suitable means such as a roller fitted with a plurality of needles. With the aforesaid processes, the urethane foam is uniformly impregnated with the bitumen compositions so that the latter will no longer flow out from the foam even under high temperature environments (above 120° C.). This heat resistant characteristic is particularly advantageous for automotive applications where temperature tends to go high in the rear compartment of the vehicle.

This acoustic absorber is available under the trade name of Super Seal-A from Nihon Hatsujo Kabushiki Kaisha, Japan. The physical properties of the absorber which are suitable for the present invention are as follows:

| | |
|---|---|
| (1) Density | 0.13 ± 0.015 grams/cm$^3$ |
| (2) Tensile strength | 1.0 kg/cm$^2$ |
| (3) Coefficient of water absorption under 50% compression | 7% or less |
| (4) Stress under 50% compression | 50 to 80 grams/cm$^2$ |
| (5) Permanent strain under 50% compression | 10% or less |
| (6) Coefficient of sound absorption | 0.22% at 125 Hz<br>0.69% at 250 Hz<br>0.50% at 500 Hz<br>0.47% at 1000 Hz<br>0.61% at 2000 Hz |

Because of the elasticity of the absorber of the invention, the opening 3*a* of the cylindrically shaped absorber 3 has a smaller diameter "d" than the diameter "D" of the driving unit 1 of the speaker so that the absorber 3 can be secured to the rearside of the speaker by simply squeezing the latter into the opening of the former as shown in FIG. 1. The absorber 3 is preferably secured in position using an adhesive.

Figure 4:
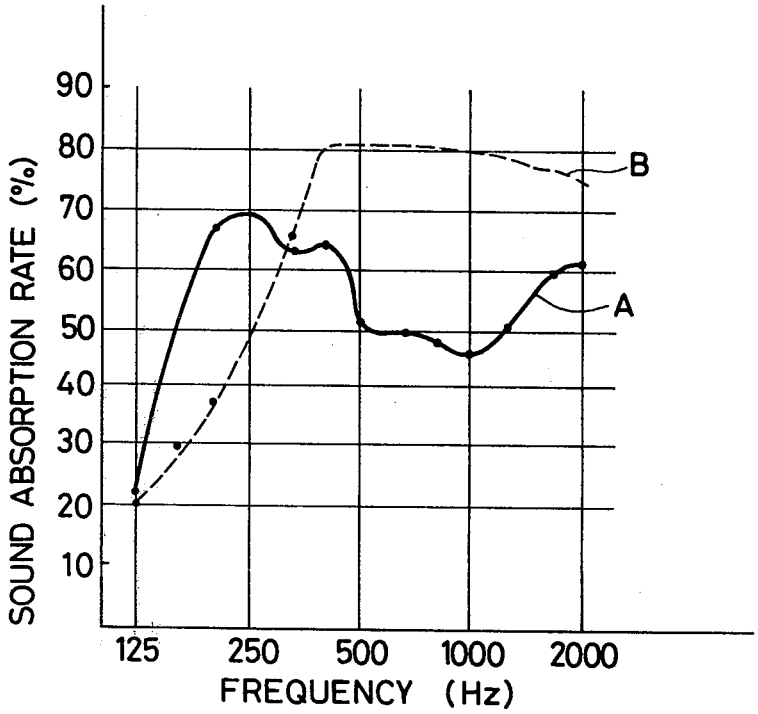
FIG. 4 is a graphic representation of the acoustic absorption characteristics of the absorber employed in the invention for comparison with the conventional absorbing material.

FIG. 4 illustrates the sound absorption characteristic of the absorber employed in the invention for comparison with a conventionally employed glass wool. An indicated by curve A, the absorber employed in the invention has a greater absorption capability in the lower frequency end of the audible spectrum in comparison with curve B representing the characteristic of glass wool.

Figure 5:
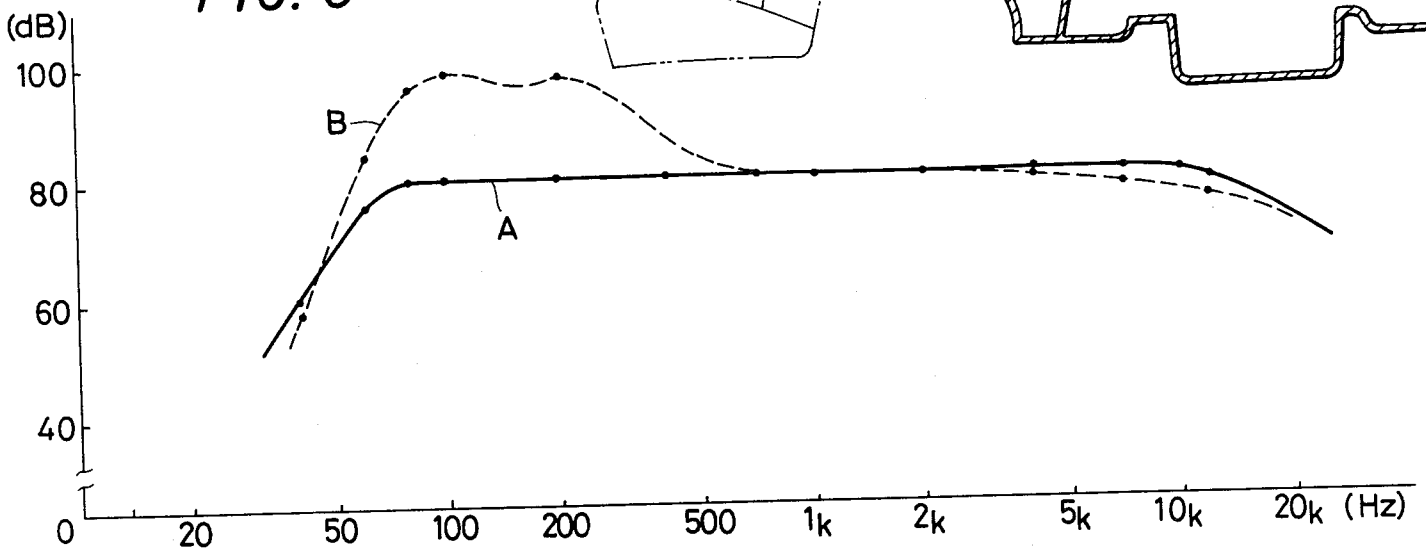
FIG. 5 is a graphic representation of the frequency response characteristic of the apparatus of the invention in comparison with a loudspeaker without the acoustic absorber of the invention.

FIG. 5 is a graphic illustration of the acoustic characteristic of the absorber 3. Curve B represents the characteristic of a speaker without the acoustic absorber 3 and curve A represents the characteristic of the speaker with the absorber 3. It is seen that the undesirable resonant peaks which occur in a range from 50 to 500 Hz are suppressed to an acceptable level.

What is claimed is:

1. Acoustic apparatus comprising a loudspeaker having a cone-shaped diaphragm, a driving unit for driving said diaphragm in response to an electrical signal applied thereto, a framework secured to said driving unit, the outer edge of said cone-shaped diaphragm being resiliently secured to the outer edge of said framework, said framework having a plurality of openings therein to provide communication between a space immediately behind the diaphragm and a space rearwardly of said framework, and an acoustic absorber comprising an air transmissive elastic body of bitumen-containing urethane foam annular in shape and having an axial opening therethrough which opening in the relaxed condition of said body is substantially smaller in cross-sectional area than the area of said driving unit which body is attached to the rear side of said framework by elastically enlarging said opening to cover said plurality of openings and retained in position solely by the elasticity of the body itself, said elastic body comprising a hydrocarbon-containing bituminous compound, a polyol-polydiene and a polyisocyanate.

2. Acoustic apparatus comprising a loudspeaker having an apertured structure to which a diaphragm is resiliently mounted to produce sound waves in response to electrical signals, and an air transmissive elastic body of urethane foam comprising a hydrocarbon-containing bituminous compound, a polyol-polydiene and a polyisocyanate, said elastic body being attached to the rearside of said apertured structure in face-to-face relation to receive said sound waves rearwardly emanating from said diaphragm through the aperture of said structure.

3. Acoustic apparatus in combination with an automotive vehicle, comprising a loudspeaker air tightly received in an opening of a panel which isolates the passenger compartment of the vehicle from a rear compartment and including an apertured structure to which diaphragm is resiliently mounted to produce sound waves in response to electrical signals, and an air transmissive elastic body of urethane foam comprising a hydrocarbon-containing bituminous compound, a polyol-polydiene and a polyisocyanate, said elastic body being attached to the rearside of said apertured structure in face-to-face relation to receive said sound waves rearwardly emanating from said diaphragm through the aperture of said structure.

4. Acoustic apparatus as claimed in claim 2 or 3, wherein said elastic body has an air transmissivity of approximately 25 cc/cm$^3$/second.

5. Apparatus as claimed in claim 2 or 3, wherein said hydrocarbon-containing bituminous compound is substantially composed of hydrocarbon having a melting point of 150° C. or less and a boiling point of 200° C. under the normal atmospheric pressure.

6. Apparatus as claimed in claim 5, wherein the weight of said polyisocyanate is in a range between 0.8 and 1.25 in relation to the polyol composition and the active hydrogen molecules.

* * * * *